US007629520B1

(12) United States Patent
Garcia

(10) Patent No.: US 7,629,520 B1
(45) Date of Patent: Dec. 8, 2009

(54) ENZOTAR

(76) Inventor: Enzo Garcia, 24 Madera Way, Mill Valley, CA (US) 94941

( * ) Notice: Subject to any disclaimer, the term of this patent is extended or adjusted under 35 U.S.C. 154(b) by 0 days.

(21) Appl. No.: 12/207,577

(22) Filed: Sep. 10, 2008

(51) Int. Cl.
*G10D 3/00* (2006.01)

(52) U.S. Cl. ..... 84/290; 84/173

(58) Field of Classification Search ..... 84/290, 84/173, 268–272, 291–296; D17/14–15
See application file for complete search history.

(56) References Cited

U.S. PATENT DOCUMENTS 1,635,429 A * 7/1927 Miller ..... 84/274
4,616,550 A * 10/1986 Lacroix et al. ..... 84/173
6,143,965 A * 11/2000 Chand ..... 84/290

* cited by examiner

*Primary Examiner*—Jianchun Qin
(74) *Attorney, Agent, or Firm*—Young Basile

(57) ABSTRACT

A single stringed instrument comprising a tapered cylindrical wood body having a pair of thin flexible aluminum arms extending therefrom the joined together at a head which carries a tensioner bar. A single string extends between the tensioner bar and the bottom or base of the body. The instrument is played by plucking the string and squeezing the arms together to vary the pitch of the tone produced by the string.

7 Claims, 3 Drawing Sheets

ENZOTAR

FIELD OF THE INVENTION

This invention relates to musical instruments and more particularly to a stringed musical instrument which is easily played by both children and adults.

BACKGROUND OF THE INVENTION

Multiple stringed instruments such as guitars, banjos and ukuleles as well as variations such as sitars and balalaikas are among the most popular musical instruments in the world. Typical of such instruments is a fret board against which a string or combination of strings is pressed to change the effective length and pitch thereof during play.

SUMMARY OF THE INVENTION

The present invention is a simplified guitar-like instrument which does away with the fret board and eliminates the necessity for pressing strings against a fret board to change the pitch or tone of the notes being played by plucking the string.

In general, the present invention is constructed in the form of an instrument having a string which extends between an anchor at the bottom of a generally cylindrical body, and a distal tensioner mounted in a head which is supported relative to the body by a pair of thin flexible arms, preferably made of metal. To play the instrument, one plucks the string and squeezes the arms together. The squeezing action effectively shortens the distance between the tensioner and the anchor point of the string, thus changing the tension on the string and the tone produced thereby.

Other applications of the present invention will become apparent to those skilled in the art when the following description of the best mode contemplated for practicing the invention is read in conjunction with the accompanying drawings.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
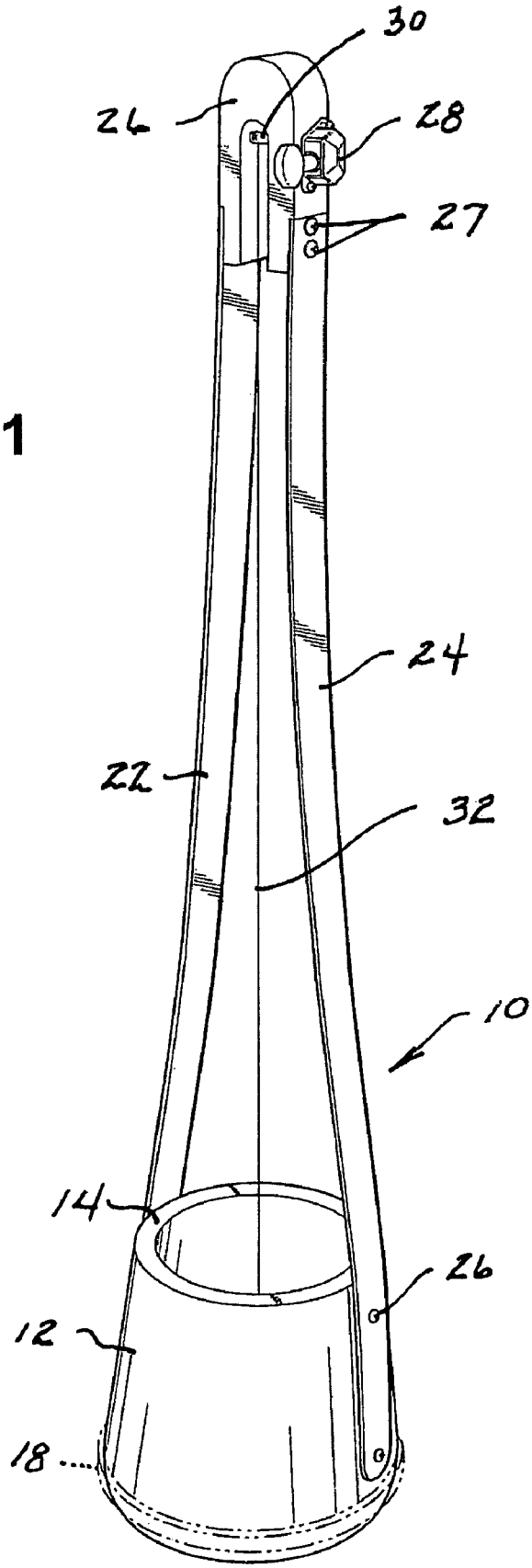
FIG. 1 is a perspective view of an illustrative embodiment of the invention in a single-stringed instrument using thin, aluminum arms to vary the tension and tone of the single string.

Referring to the figures, the present invention is a single stringed instrument 10 comprising a tapered cylindrical body 12 having an open top defined by a peripheral edge 14 with a diameter of approximately 4½ inches and an overall height of approximately 5½ inches. The bottom of the body 12 is covered by a thin, skin-like material 16 which acts as a resonator and also serves as an anchor point for a string 32 as hereinafter described. A decorative band of fabric 18 is adhesively bonded to the body 12 at the junction of the body with the bottom skin 16 to improve the aesthetics of the instrument 10.

A neck is formed by a pair or opposed mirror-image thin, flexible aluminum arms 22, 24 approximately one inch in width and approximately 24 inches in length. The thin aluminum arms 22, 24 are attached by screws 26 to the outside surface of the body 12 and by screws 27 to a U-shaped wooden head 26. A conventional tensioner 28 is mounted between the opposite legs of the head 26 and includes a rotatable bar 30 to which a string 32 is attached in conventional fashion; i.e., there is a small hole in the bar through which the string is inserted before winding it around the bar.

Figure 2:
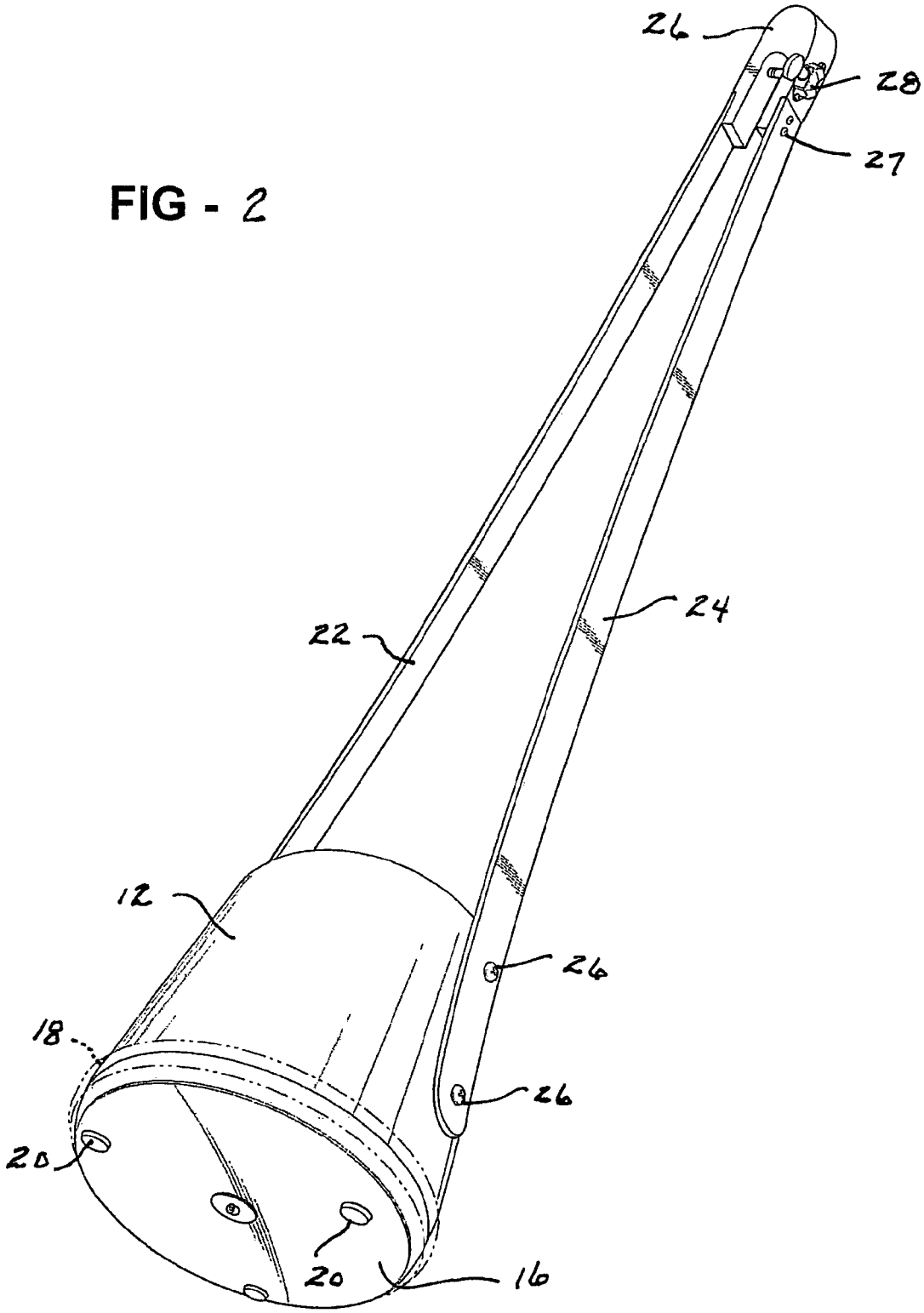
FIG. 2 is another perspective view of the invention showing the details of the bottom or base of the instrument.

The single string 32 is attached to the instrument between an anchor washer 34 on the outside surface of the bottom skin 16 as best shown in FIG. 2 and extends up through the center of the body and out the open top, between the arms 22, 24 to the tensioner bar 30. It is wound around the tensioner bar and adjusted to the desired tension and pitch in a manner which will be apparent to persons skilled in the art. Soft plastic feet 20 are disposed at uniform intervals to the bottom skin 16 as shown in FIG. 2 such that the instrument may be played by resting it on the floor. It is also stored and displayed on the feet 20.

Figure 3:
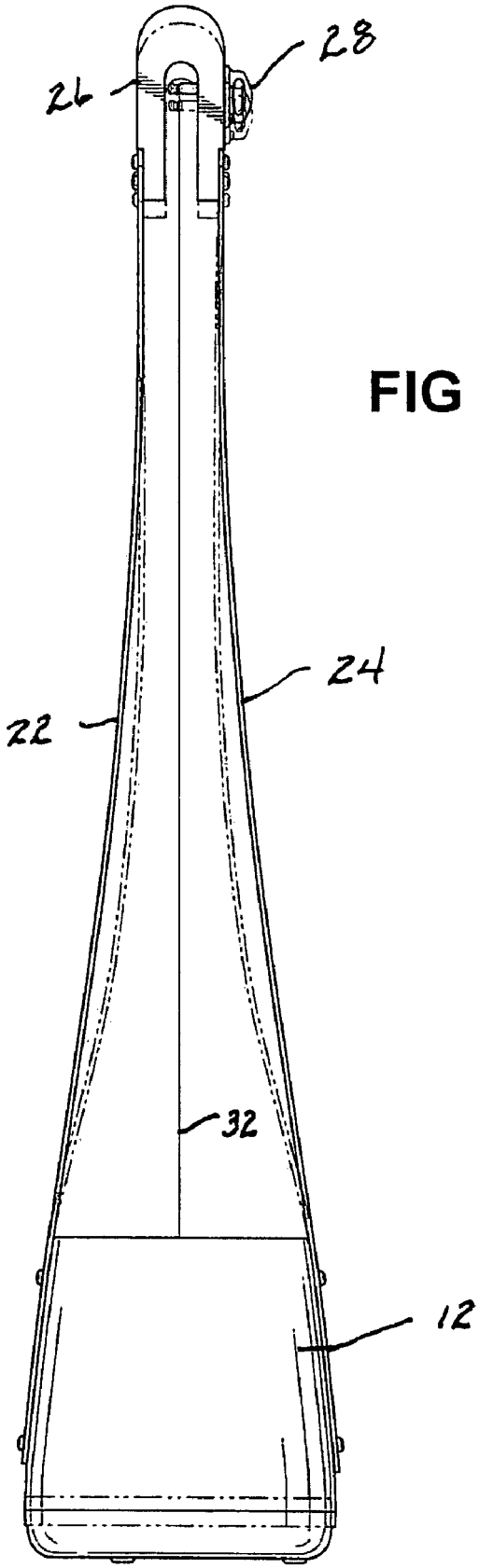
FIG. 3 is a side view illustrating the manner in which the pitch and tone of the single string is changed by squeezing the metal arms forming the neck of the instrument together.

To play the instrument 10, the string 32 is plucked and the player simply squeezes the arms 22, 24 together as shown in FIG. 3. Squeezing the arms together as shown by the dotted lines, shortens the distance between the anchor washer and the tensioner bar 30 and reduces the tension and lowers the tone or pitch of the string 32. After a short period of training, even a child can quickly learn to pluck the string and squeeze the arms 22, 24 together and/or release the arms from a squeezed position to change the pitch of the string 32 in a pleasant and melodic fashion.

The base or body 12 is preferably made of wood and is assembled by gluing together longitudinal strips which are then machined or sanded on the outside surface to produce a smooth, tapered, cylindrical surface which is thereafter painted to improve the aesthetics. The bottom skin 16 uses a material similar to that used to provide a contact head on a drum, such as a bongo or snare drum and may be either natural or synthetic in composition. A natural skin would come from an animal hide whereas a synthetic material would be largely made of plastic or a cellulose material which is impregnated with a suitable polymer. The arms are preferably aluminum, but other materials including non-metals may also be used. The head is made of a hardwood such as maple, rosewood, birch or teak and is sanded to a smooth outer surface and painted to match the body 12.

Variations on the instrument will be apparent to those skilled in the art. For example, a double string using two tensioner bars may be used such that the two strings may be spaced one or more octaves apart or harmonized with one another and plucked simultaneously. Other multiple string arrangements can also be employed. The string may be either solid or wound and of any desired gauge to determine the general pitch of the instrument. The sizes given herein are purely illustrative and the instrument may be made larger or smaller according to its desired end use.

What is claimed is:

1. A fretless stringed instrument comprising:

a generally cylindrical body having a center axis of symmetry, an open top and a closed bottom;

a neck comprising two mirror-image thin flexible arms extending generally parallel to said axis of symmetry from and opposingly attached at a first end to diametrically spaced apart points on said body, said arms having distal ends opposite the first end and defining an open space therebetween;

a head mounted between said distal ends; and a pluckable string tensioned in said open space between said head and the bottom of said body along said axis of symmetry, passing through the open top of said body;

said arms being the sole support between said body and said head such that squeezing said arms together reduces the tension in the string and the pitch of a tone produced by plucking same.

2. A stringed instrument as defined in claim 1 further comprising a tensioner mounted in said head, said string being attached to said tensioner.

3. A stringed instrument as defined in claim 1 wherein the bottom of said cylindrical body comprises a thin resonating skin of natural or synthetic material.

4. A stringed instrument as defined in claim 3 wherein the body is made of wood.

5. A stringed instrument as defined in claim 1 wherein said cylindrical body is tapered in such a way that its diameter is greater at the bottom.

6. A stringed instrument as defined in claim 1 wherein the arms are made of aluminum and are attached to said head by screws.

7. A method of playing a fretless stringed instrument of the type as defined in claim 1 comprises the steps of:

plucking the string and, while the string is vibrating, squeezing and releasing the arms to change the pitch of a tone produced by the string.

* * * * *